US010265668B2

(12) United States Patent
Boettcher et al.

(10) Patent No.: US 10,265,668 B2
(45) Date of Patent: Apr. 23, 2019

(54) MIXING METHODS

(71) Applicants: Sartorius Stedim Biotech GmbH, Goettingen (DE); Jonathan E. Cutting, East Setauket, NY (US)

(72) Inventors: Lars Boettcher, Melsungen (DE); Jonathan E. Cutting, East Setauket, NY (US); Sharon D. West, Sunnyside, NY (US); Martin Oschwald, Tagelswangen (CH)

(73) Assignee: Sartorius Stedim Biotech GmbH (DE)

( * ) Notice: Subject to any disclaimer, the term of this patent is extended or adjusted under 35 U.S.C. 154(b) by 315 days.

(21) Appl. No.: 15/010,113

(22) Filed: Jan. 29, 2016

(65) Prior Publication Data

US 2017/0216801 A1 Aug. 3, 2017

(51) Int. Cl.

| | |
|---|---|
| ***B01F 15/00*** | (2006.01) |
| ***B01F 3/12*** | (2006.01) |
| ***B01F 7/00*** | (2006.01) |

(52) U.S. Cl.

CPC ..... *B01F 15/00389* (2013.01); *B01F 3/1221* (2013.01); *B01F 7/00383* (2013.01); *B01F 15/00201* (2013.01); *B01F 2003/125* (2013.01); *B01F 2015/00636* (2013.01); *B01F 2015/00642* (2013.01)

(58) Field of Classification Search

CPC ..... B01F 15/00389

See application file for complete search history.

(56) References Cited

U.S. PATENT DOCUMENTS 4,305,673 A * 12/1981 Herbst ..... B01F 7/0025 261/93
4,421,414 A * 12/1983 Holupko ..... B01F 3/04531 241/46.17
4,473,001 A * 9/1984 Rieger ..... C12G 1/02 366/196
4,520,286 A * 5/1985 Bukoschek ..... A47J 19/02 192/143
4,696,166 A * 9/1987 Bukoschek ..... A23G 9/12 366/601
4,759,192 A * 7/1988 Bertram ..... A23G 9/12 62/136
5,462,580 A * 10/1995 Eckert ..... B01F 3/04248 75/678
5,727,876 A * 3/1998 Tynan ..... B01F 7/08 366/100

(Continued)

*Primary Examiner* — Abbas Rashid
(74) *Attorney, Agent, or Firm* — Gerald E. Hespos; Michael J. Porco; Matthew T. Hespos

(57) ABSTRACT

A mixing method, a controller and a mixing device for mixing components in a mixing vessel are provided. The mixing method includes providing a mixing impeller in the mixing vessel; accelerating the mixing impeller from an inactive state to a rotating state in which the mixing impeller rotates at a first desired speed in a first rotation direction; rotating the mixing impeller at the first desired speed for a first time $t_{steady,1}$ in the first rotation direction; changing the rotation direction of the mixing impeller, so that the mixing impeller rotates in a second rotation direction at a second desired speed; and rotating the mixing impeller at the second desired speed for a second time $t_{steady,2}$.

4 Claims, 4 Drawing Sheets

(56) References Cited

U.S. PATENT DOCUMENTS

| | | | | |
|---|---|---|---|---|
| 6,305,837 | B1 * | 10/2001 | Clavel | C12G 1/02 366/286 |
| 6,634,784 | B2 * | 10/2003 | Blakley | B01F 7/001 366/330.2 |
| 7,306,719 | B2 * | 12/2007 | Tormaschy | B01F 3/04609 210/170.05 |
| 8,807,824 | B2 * | 8/2014 | Bodum | A47J 43/0465 366/144 |
| 9,016,931 | B2 * | 4/2015 | Rumph | B01F 7/00116 366/285 |
| 2013/0051173 | A1 * | 2/2013 | Braker | A23G 1/0043 366/145 |

* cited by examiner

MIXING METHODS

BACKGROUND

1. Field of the Invention

The invention relates to mixing methods for mixing components in a mixing vessel in alternate directions.

2. Related Art

In industrial mixing equipment, the geometry of a mixing vessel and the design of a mixing impeller provided in the mixing vessel provide a wide range of flow behaviors when mixing components in the mixing vessel. If the mixing vessel is not adequately baffled, a tangential "swirling" motion dominates and axial "up and down" flow is suppressed. In the worst case, the components in the mixing vessel may move as a single body. This condition, which is marked by a strong central vortex, is actually known by researchers to be detrimental for several reasons. Air, which is ingested into the mixing vessel, can introduce dangerous instability into the rotating mixing impeller. The central vortex can actually prevent floating solids from being incorporated into the bulk. The increased air/liquid interface can damage sensitive molecules, for example proteins.

In conventional engineering practice, it is recommended that mixing vessels are baffled to eliminate the swirling tangential motion and thereby suppress the central vortex. Baffles generally take the form of narrow plates that extend outward from a mixing vessel wall. In most mixing vessels, for example stainless mixing vessels, the addition of such baffles are economical and practical.

In a single-use mixing vessel, like a flexible single-use bioreactor, however, the addition of rigid baffles is cumbersome. Rigid baffles complicate the folding of empty bags. In addition, the flexible walls of the single-use mixing vessel do not offer a convenient support structure for rigid baffles. One approach which has been adopted by several companies is to use a square or rectangular container as a mixing vessel. The corners of such a rectangular mixing vessel behave like virtual baffles, interrupting the swirling tangential flow and promoting axial flow. However, it is not often possible to achieve a perfect 90 degrees angle at all corners of the single-use container. Since the tolerances on bag dimensions are generally much larger than the tolerances on rigid box dimensions, it may be that the bag is intentionally undersized compared to its rigid support structure to ensure that there is not excess material that would pose a challenge during installation or filling of the bag. Undersizing the bag results in rounding at the corners, and this rounding at the corners has been shown to promote swirling tangential flow.

Therefore, it is desired to prevent the swirling tangential flow and promote axial flow in unbaffled cylindrical mixing vessels and for square or rectangular mixing vessels.

SUMMARY

The underlying technical problem has been solved by a mixing method for mixing components in a mixing vessel, comprising:

providing a mixing impeller in the mixing vessel;

accelerating the mixing impeller from an inactive state to a rotating state in which the mixing impeller rotates at a first desired speed in a first rotation direction;

rotating the mixing impeller at the first desired speed for a first time $t_{steady,1}$ in the first rotation direction;

changing the rotation direction of the mixing impeller, so that the mixing impeller rotates in a second rotation direction at a second desired speed; and rotating the mixing impeller at the second desired speed for a second time $t_{steady,2}$.

A "mixing vessel" is either a rigid or flexible container in which components to be mixed are accommodated. In particular, solid, liquid and/or gaseous components may be mixed in the mixing vessel. Bioreactors are examples of mixing vessels.

At least one mixing impeller is provided in the mixing vessel. The mixing impeller comprises a central basis that is attached to a shaft that is driven by a motor so that the mixing impeller rotates. At least one blade is attached to this central basis and the blade extends either radially or axially with respect to a rotation axis of the mixing impeller.

The at least one blade may extend radially out from the rotation axis of the mixing impeller, like a Rushton or straight blade turbine. A Rushton turbine is an example of a turbine stirrer, and preferably has six blades extending radially outward from the shaft. The blades may be arranged vertically or diagonally with respect to the rotation axis. Preferably, the blades of the mixing impeller are configured and arranged such that the mixing impeller provides an equivalent behavior in both rotation directions.

The mixing impeller may be used for homogenizing (compensation of concentration differences of different mixable components), liquid/liquid dispersing (stirring in of a not soluble medium into another fluid), liquid/gaseous dispersing (stirring in of gaseous phase into a liquid phase), suspending (swirling up and mixing of solids in a liquid phase), and emulsifying (stirring in of a liquid phase into a second liquid).

Under the term "inactive state", one understands that the mixing impeller is not rotating. As soon as the mixing impeller starts to rotate, the mixing impeller is in the "rotating state".

The step of changing the rotation direction of the mixing impeller implies that the rotation speed is reduced from the first desired speed to a rotation speed of 0. Afterwards the mixing impeller accelerates in the second direction until the second desired speed is achieved.

The ramp duration means the time within which the mixing impeller changes its rotation direction (time from the one desired speed to the other desired speed), and depends on the design of the mixing impeller, the rotation shaft to which the mixing impeller is connected, and the motor which drives the mixing impeller. The motor may be equipped with a variable frequency drive capable of accelerating and decelerating the motor at a specified ramp speed. The ramp duration may be kept short, but long enough so that harmful transients are created when switching the rotation directions. The ramp duration may be 3 seconds, 2 seconds or 1 second.

The first desired speed and the second desired speed may be identical. Further, the first time $t_{steady,1}$. and the second time $t_{steady,2}$., within which the mixing impeller is rotating constantly, may be identical. It is, however, also possible that the speeds and/or the times differ.

Swirling flow in the fluids to be mixed can be suppressed and the mixing quality can be enhanced by alternating the rotation direction of the mixing impeller. Moreover, the mixing method described above does not require any constructional requirements of the mixing vessel, and hence the mixing method also may be used in flexible containers, like e.g. single-use bioreactors.

Additionally or alternatively to the alternation of the rotation direction of the mixing impeller, it is also possible that a control system when detecting a swirling flow in the fluids to be mixed sends an alert to the operator so that the operator is informed about the undesired swirling flow. Further alternatives to the alternation of the rotation direction of the mixing impeller as described above could be reducing the speed at which the mixing impeller rotates to a preset speed, fully stopping the rotation movement of the mixing impeller or continuously reducing the speed until a vortex in the fluid to be mixed is no longer detected. As soon as swirling flow and/or a vortex in the fluids to be mixed is no longer detected, the mixing impeller can again rotate at its original speed.

The mixing method may comprise the further step of changing the rotation direction of the mixing impeller from the second rotation direction back to the first rotation direction.

When changing the rotation direction of the mixing impeller from the second rotation direction back to the first rotation direction, it is again implied that the speed of the mixing impeller is reduced from the second desired speed toward a speed of 0 and that the mixing impeller afterwards is accelerated to the first desired speed. This allows a continuous alternation of the rotation direction of the mixing impeller.

The first or the second desired speed may be a maximum speed of the mixing impeller. Alternatively, if the first and the second desired speeds are identical, both speeds may be the maximum speed.

The maximum speed may be determined by the type of motor that is used in combination with the mixing impeller.

The rotation direction may be changed when a swirling flow is detected in the components to be mixed. Thus, a swirling tangential flow optimally can be prevented, while a beneficial transient flow is achieved.

The time at which a swirling flow is detected in the components to be mixed may be determined in a control system for controlling the mixing impeller.

As far as the properties of the components to be mixed, the liquid level in the mixing vessel and/or the effects of shape of the mixing vessel on the fluid flow are known, the time (when using specific first and second desired speeds) can be determined after which a swirling flow usually is detected in the mixing vessel. This time may be stored in a control system for controlling the mixing impeller, so that the control system automatically induces an alternation of the rotation direction of the mixing impeller. The determined time may be the time when usually a swirling flow appears for the first time or close before that time.

Alternatively or additionally, this stored time also may be used to alert the operator. Furthermore, this stored time may be used for the alternatives to the alternation of the rotation direction of the mixing impeller, as described above. It particular, this time could be used as a starting point for reducing the speed at which the mixing impeller rotates to a preset speed, fully stopping the rotation movement of the mixing impeller or continuously reducing the speed until a vortex in the fluid to be mixed is no longer detected.

The step of detecting a swirling flow in the components to be mixed may comprise the step of detecting a drop of a torque required to rotate the mixing impeller by a control system for controlling the mixing impeller.

When the swirling motion is developed fully and the components to be mixed start to rotate as a body, the torque required to turn the mixing impeller drops. The control system may detect this drop and induce afterwards an alternation of the rotation direction. The amount of the drop after which an alternation of the rotation direction is induced may be determined in the control system. Sensors may be provided at the rotation shaft or the mixing impeller for detecting the drop one or more.

Alternatively or additionally, this detection of a swirling flow may be used to alert the operator. Furthermore, this detection may be used for the alternatives to the alternation of the rotation direction of the mixing impeller as described above. It particular, this detection could be used as a starting point for reducing the speed at which the mixing impeller rotates to a preset speed, fully stopping the rotation movement of the mixing impeller or continuously reducing the speed until a vortex in the fluid to be mixed is no longer detected.

The step of detecting a swirling flow in the components to be mixed may comprise the step of detecting at least one fluctuation in a torque required to rotate the mixing impeller by a control system for controlling the mixing impeller.

When air is ingested through a central vortex into the mixing vessel, the blades of the mixing impeller experience sudden fluctuations in torque since one or more blades may have air on one side and liquid on the other side. One or more sensors may be provided e.g. at the rotation shaft that applies the torque to rotate the mixing impeller for detecting the fluctuations. The strength and/or the length of such fluctuations may be determined in the control system so that the control system may induce an alternation of the rotation direction of the mixing impeller when such fluctuations are detected.

Alternatively or additionally, this detection of a swirling flow also may be used to alert the operator. Furthermore, this detection may be used for the alternatives to the alternation of the rotation direction of the mixing impeller as described above. In particular, this detection could be used as a starting point for reducing the speed at which the mixing impeller rotates to a preset speed, fully stopping the rotation movement of the mixing impeller or continuously reducing the speed until a vortex in the fluid to be mixed is no longer detected.

One or more of the various methods for determining when an alternation of the rotation direction is induced by the control system as described above may be used alternatively or in combination.

It may be beneficial to determine minimum and maximum durations regarding the rotation of the mixing impeller in one direction when using any one of the above methods in which sensors are required for determining when an alternation of the rotation direction shall be induced. Thereby, incorrect sensor measurements or process errors can be avoided.

The underlying technical problem also has been solved by a controller adapted to control a mixing impeller such that a mixing method according to any one of the previous described embodiments can be carried out.

According to a further aspect of this disclosure, the underlying technical problem has been solved by a mixing device for mixing components, comprising:

- a mixing vessel being adapted to accommodate the components to be mixed;
- a mixing impeller arranged inside of the mixing vessel and being adapted to mix the components when being rotated;
- a drive unit for driving the mixing impeller; and
- a controller, which is adapted to control the mixing impeller such that the following steps are carried out by the mixing impeller:

accelerating the mixing impeller from an inactive state to a rotating state in which the mixing impeller rotates at a first desired speed in a first rotation direction;

rotating the mixing impeller at the first desired speed for a first time $t_{steady,1}$ in the first rotation direction;

changing the rotation direction of the mixing impeller, so that the mixing impeller rotates in a second rotation direction at a second desired speed; and rotating the mixing impeller at the second desired speed for a second time $t_{steady,2}$.

The mixing vessel may be a single-use container.

According to another aspect of this disclosure, it is known that some mixing impellers generate a flow pattern that is independent of the rotation direction in which the mixing impeller is rotated. Rushton impellers and straight blade turbines fall into this category. Other mixing impellers, however, provide different flow patterns depending on the rotation direction. A few radial flow impellers and most axial flow impellers fall into this second category.

It is desirable to offer a high degree of versatility to the end user in the field of single-use mixing vessels, like single-use bioreactors, so that a small number of products may be used in a range of applications as wide as possible.

For pharmaceutical manufacturing it is desirable to have a mixing impeller that can handle both downstream applications as well as buffer/media preparations. In downstream applications, the mixing often refers to a liquid/liquid homogenization of an aqueous solution containing sensitive molecules, like e.g. therapeutic proteins. The proteins are sensitive to shear and to interfacial forces. Thus, it is desirable to have a gentle low-shear fluid flow free of bubbles. In a buffer/media preparation, the mixing usually refers to the dissolution of powder in an aqueous solution and no sensitive molecules, like e.g. therapeutic proteins, are present. Here it is desirable to have a strong, chaotic mixing performance to disrupt concentration gradients and maintain powders suspended.

This underlying technical problem has been solved by a mixing method for providing various flows in components to be mixed, comprising:

providing a mixing impeller in a mixing vessel having at least one blade which extends radially in a back-swept manner with respect to a first rotation direction of the mixing impeller;

rotating the mixing impeller in the first rotation direction when mixing aqueous fluids containing sensitive molecules; and rotating the mixing impeller in a second rotation direction when mixing at least one powder with at least one aqueous fluid.

The mixing impeller has a circular basis from which the at least one blade radially extends. The term "back-swept" means that the at least one blade of the mixing vessel radially extends from the circular basis of the mixing impeller such that angles between the opposite mixing surfaces of the blade and a lateral surface of the circular basis of the mixing impeller are different from 90 degrees. In particular, there is an angle of larger than 90 degrees between a first mixing surface of the blade and an angle smaller than 90 degrees between an opposite second mixing surface of the blade.

The inventive mixing method uses a mixing impeller already known from the art in a mixing vessel, however, in different rotation directions depending on the required application. In particular, beneficial downstream (gentle) applications can be achieved when rotated in the first rotation direction and buffer/media applications (chaotic) when rotated in the opposite/second rotation direction.

The step of providing a mixing impeller may comprise providing at least one curved blade.

In this respect, the blades of the mixing impeller may be formed like in a centrifugal pump impeller.

When rotated in the "gentle" rotation direction, a blade arrangement having curved blades reduces the torque required to turn the mixing impeller (compared to a straight blade impeller) and the retreating blades reduce the shear stress applied to the fluids (preferably liquids) to be mixed. When rotated in the "chaotic" rotational direction, more torque is required to rotate the mixing impeller at a given speed than in the opposite rotation direction. This results in a higher power draw of the mixing impeller. According to the Grenville correlation, the higher power draw results in a beneficial lower blend time.

These and other objects, features and advantages of the present invention will become more evident by studying the following detailed description of preferred embodiments and the accompanying drawings. Further, it is pointed out that, although embodiments are described separately, single features of these embodiments can be combined for additional embodiments.

DETAILED DESCRIPTION

Figure 1:
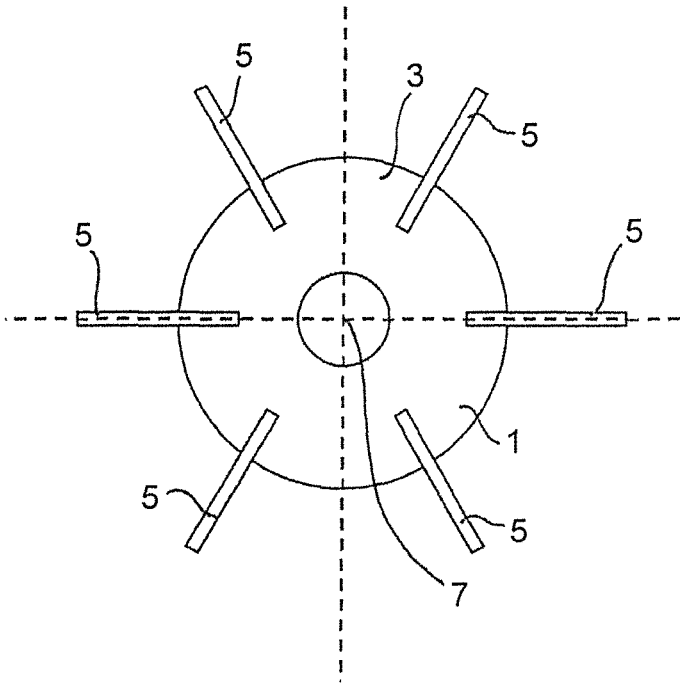
FIG. 1 is a top plan view of a mixing impeller having straight blades.

According to a first embodiment of the invention, a mixing impeller 1 is provided (see FIG. 1) and may be arranged in a mixing vessel. The mixing vessel may be a rigid or flexible container in which various fluids, like solid, liquid and/or gaseous products, are mixed by the mixing impeller 1. The mixing impeller 1 is controllable by a control system so that the mixing impeller 1 is rotatable in a first rotation direction and in a second rotation direction that is opposite the first rotation direction. Exemplary, the first rotation direction may be a clockwise direction CW and the second rotation direction may be a counterclockwise direction (CCW), or vice versa. Preferably, the mixing impeller 1 has equivalent behaviors in both rotation directions, like e.g. a Rushton or straight blade turbine. FIG. 1 shows a Rushton turbine. The mixing impeller 1 may be a radial flow impeller having a circular basis 3 from which at least one blade 5 radially extends. FIG. 1 shows the specific case of six blades 5 arranged evenly along the circular basis 3. A rotational axis of the mixing impeller 1 extends through the center 7 of the circular basis 3 and the blades 5 extend vertically along the rotational axis.

The above described mixing impeller 1 is applied for a mixing method according to the first embodiment of the invention, by which swirling tangential flow in the components to be mixed is prevented.

Figure 2:
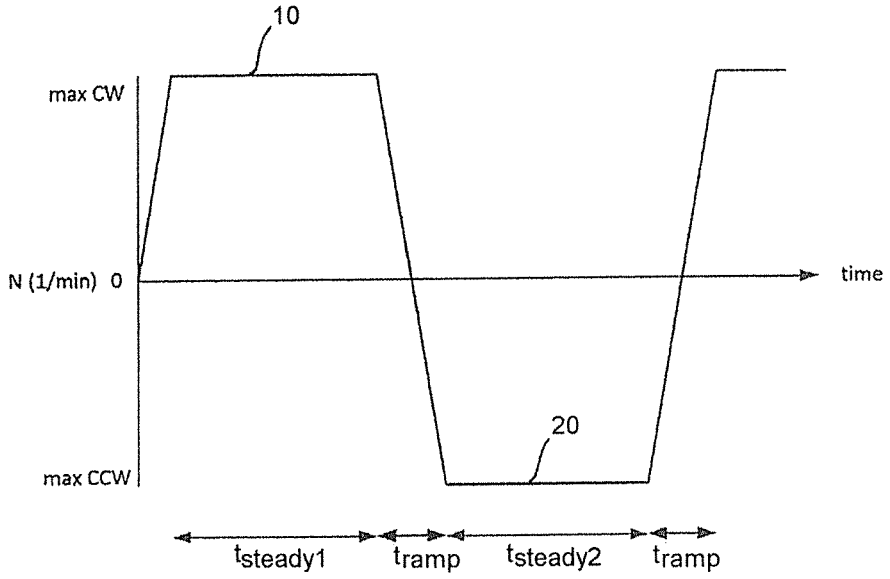
FIG. 2 is a graph indicating the speed of the mixing impeller in view of the time when applying the mixing method according to the first embodiment of the invention.

FIG. 2 shows the mixing method by means of a graph. The graph indicates the speed of rotation N of the mixing impeller 1 in view of the time.

Initially, the mixing impeller 1 is accelerated from an inactive state, in which the speed of rotation N is 0, to a rotating state. The rotating state starts as soon as the mixing impeller 1 is rotating. In the step of accelerating the mixing impeller 1, the mixing impeller 1 is accelerated from the speed of rotation N of 0 to the first desired speed 10. As shown in FIG. 2, the first desired speed 10 may be the maximum speed of the mixing impeller 1. The mixing impeller 1 rotates in a first rotation direction, which is clockwise in FIG. 2. Alternatively, the first rotation direction may be counterclockwise. The time within which the mixing impeller 1 is accelerated from the speed of rotation N of 0 to the first desired speed 10 (ramp time $t_{ramp}$) may be determined in the control system. Usually the ramp time $t_{ramp}$ depends on the design limitations of the mixing impeller 1, a rotation shaft to which the mixing impeller 1 is connected, and/or the motor that drives the mixing impeller 1 and the rotation shaft. Preferably, the motor is equipped with a variable frequency drive capable of accelerating and decelerating the motor at a specified ramp speed.

The mixing impeller is rotated at a constant rotation speed N for a time $t_{steady,1}$. after reaching the first desired speed 10. Preferably, the duration of time $t_{steady,1}$. is as long as possible, but should be limited to the point of time when swirling flow is detected in the components to be mixed. This time usually depends on the geometry of the mixing vessel, the geometry of the mixing impeller 1, and the properties of the components to be mixed.

The speed of rotation N of the mixing impeller 1 is reduced from the first desired speed 10 to the speed of rotation N of 0 when swirling flow appears. Afterwards the mixing impeller 1 is accelerated again, but now to a second desired speed 20 in a second rotation direction. The second rotation direction in FIG. 2 is counterclockwise. In other words, the rotation direction of the mixing impeller 1 is alternated, preferably as soon as swirling flow is detected in the components to be mixed.

The ramp time $t_{ramp}$, within which the mixing impeller 1 has alternated its rotation direction and has achieved the second desired speed 20, preferably is kept short, but it should not be so short that harmful transients are created when switching rotation directions.

At the second desired speed 20, the mixing impeller 1 is rotated constantly for the time $t_{steady,2}$. The second desired speed 20 is maintained for the time $t_{steady,2}$ as long as possible, but should be limited to the point of time when swirling flow is detected in the components to be mixed. If swirling flow appears, the rotation direction is alternated again, i.e. from the second rotation direction toward the first rotation direction. Again, the ramp time $t_{ramp}$, within which the mixing impeller 1 has alternated its rotation direction and has achieved the first desired speed 10, is kept short, but should not be so short that harmful transients are created when switching rotation directions. Preferably, the time $t_{ramp}$ is identical whenever the rotation direction is alternated. It is, however, also possible that the time $t_{ramp}$ differs in the different cycles of changing the rotation direction The time $t_{steady,1}$ and $t_{steady,2}$ may be identical or different.

The point of time when the mixing impeller 1 alternates its rotation direction or, in other words, the duration of $t_{steady,1}$ and $t_{steady,2}$ may be determined in the control system, so that the control system induces the alternation of the rotation direction. The determination may be carried out by various methods.

Option 1:

According to Option 1, a desired duration of time $t_{steady}$ may be determined and stored in the control system. Accordingly, as soon as the time $t_{steady}$ expires, the control system would induce a change of the rotation direction.

The determined duration of time $t_{steady}$ may be based on the knowledge about properties of the fluids to be mixed, the liquid level in the mixing vessel and/or the effects of shape of the mixing vessel on the fluid flow. Based on this knowledge the typical time may be determined after which usually a swirling flow is detected in the components to be mixed.

Option 2:

When a swirling motion is fully developed and the components to be mixed start to rotate as a body, the torque required to turn the mixing impeller drops. The control system may detect this drop as Option 2 and induce afterwards an alternation of the rotation direction. The amount of the drop after which an alternation of the rotation direction is induced may be determined in the control system. One or more sensors may be provided at the rotation shaft or the mixing impeller for detecting the drop.

Option 3:

As Option 3 fluctuations regarding the torque required to rotate the mixing impeller may be detected.

When air is ingested through a central vortex into the mixing vessel, the blades of the mixing impeller experience sudden fluctuations in torque since one or more blades may have air on one side and liquid on the other side. One or more sensors may be provided e.g. at the rotation shaft that applies the torque to rotate the mixing impeller for detecting the fluctuations in torque. The strength and/or the length of such fluctuations may be determined in the control system so that the control system may induce an alternation of the rotation direction of the mixing impeller when such fluctuations are detected.

Figure 3:
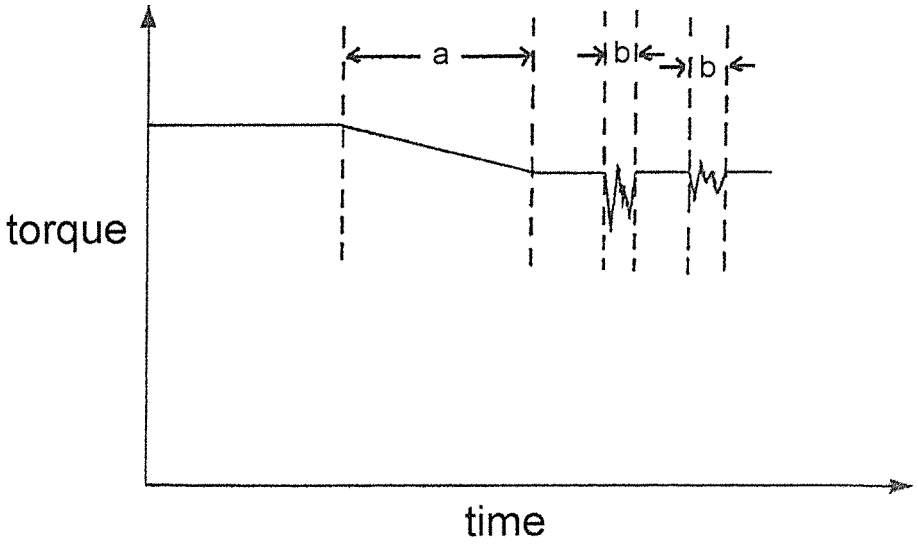
FIG. 3 is a graph further graph of the torque of the mixing impeller in view of the time indicating various fluctuations in the torque.

FIG. 3 graphically shows such fluctuations in the torque of the mixing impeller 1 in view of the time.

At first the torque of the mixing impeller 1 is substantially constant. However, as soon as a swirling flow appears in the components to be mixed, a gradual decline in the torque appears (see time interval a) as explained with respect to Option 2. If air is ingested through a central vortex, sudden fluctuations in the torque appear as explained above (see time intervals b).

The second and third Options may be complemented by the determination of minimum and maximum time durations of $t_{steady}$ stored in the control system. Thereby incorrect sensor measurements or process errors could be compensated.

The undesired swirling flow can be prevented and the mixing quality can be enhanced by means of the periodic alternations of the rotation direction of the mixing impeller 1.

The first embodiment describes that a swirling flow may be suppressed by alternating the rotation direction of the mixing impeller as soon as a swirling flow is detected. However, it is also possible any one of the following actions are carried out when detecting a swirling flow: reducing the speed at which the mixing impeller rotates to a preset speed, fully stopping the rotation movement of the mixing impeller or continuously reducing the speed until a vortex in the fluid to be mixed is no longer detected. As soon as swirling flow and/or a vortex in the fluids to be mixed is no longer detected, the mixing impeller can again rotate at its original speed. Any of the above described detection methods could be used for starting any one of the previously described alternative actions.

Alternatively or additionally, an alert may be sent to the operator when detecting a swirling flow.

Figure 4:
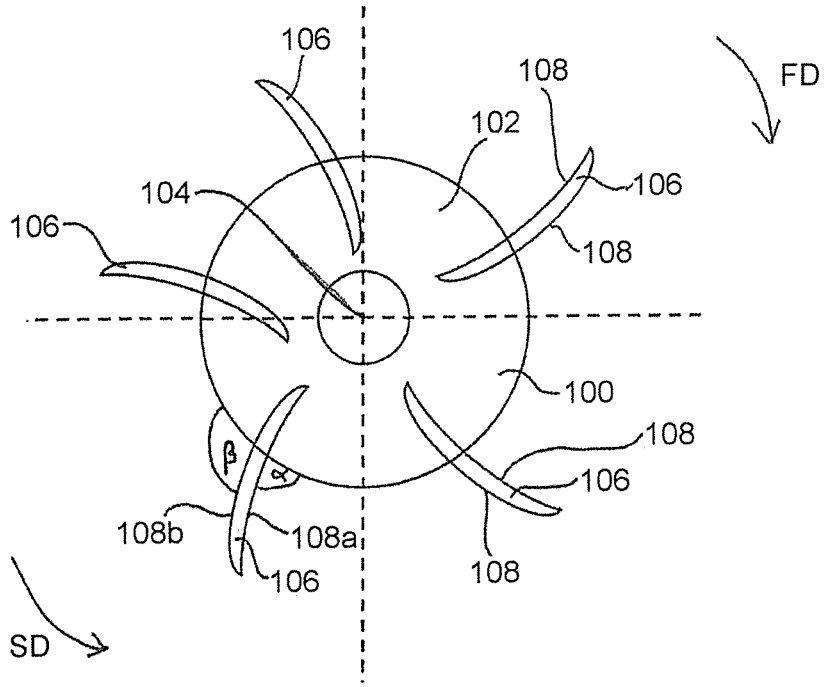
FIG. 4 is a top plan view of a mixing impeller having back-swept blades.

According to a second embodiment of a mixing method of the invention, a mixing impeller 100 is provided and has a circular base 102. As shown in FIG. 4 a rotation axis of the mixing impeller 100 extends through a center 104 of the circular base 102. At least one blade 106 radially extends from the circular base 102 and has mixing surfaces 108 that extend vertically along the rotation axis. In particular, the at least one blade 106 has two opposite mixing surfaces 108.

The at least one blade 106 is arranged with respect to the circular base 102 in a back-swept manner so that an angel $\alpha$ between a first mixing surface 108*a* and the circular base 102 is smaller than 90 degrees, and an angle $\beta$ between a second mixing surface 108*b* and the circular base 102 is larger than 90 degrees. In other words, the at least one blade 106 is back-swept with respect to a first rotation direction FD. A synonym for "back-swept" is backward-leaning. Preferably, as shown in FIG. 3, the at least one blade 106 is curved.

When rotating the mixing impeller 100 in the first rotation direction FD, which is the clockwise direction in FIG. 4, a gentle mixing is achieved, since the curved blade 106 reduces the torque required to turn the mixing impeller 100 in comparison to a mixing impeller having straight blades and the retreating blade 106 reduces the shear stress applied to the fluids to be mixed. When rotated in a second rotation direction SD (counterclockwise direction in FIG. 3), which is opposite to the first rotation direction FD, a "chaotic" mixing is achieved, since more torque is required to turn the mixing impeller 100 at a given rotation speed. This results in a higher power draw for the mixing impeller 100 and again results in a lower blend time. When rotating the mixing impeller 100 in the second rotation direction SD, the back-swept blade 106 could be also considered as a forward-leaning blade 106.

A gentle mixing method is beneficial for mixing liquid-liquid homogenization of an aqueous solution containing sensitive molecules, like e.g. therapeutic proteins, because proteins are sensitive to shear and to interfacial forces. In contrast, a "chaotic" mixing method is beneficial when the mixing includes the dissolution of powder in an aqueous solution which does not contain sensitive molecules. Any concentrations gradients could be disrupted and the powder suspended could be maintained.

Accordingly, by rotating the above described mixing impeller 100 in two different rotation directions two different ways of mixing can be achieved so that the same mixing impeller 100 can be used for different applications.

What is claimed is:

1. A mixing method for mixing components in a single-use bioreactor, comprising:

providing a mixing impeller in the single-use bioreactor;

accelerating the mixing impeller from an inactive state to a rotating state in which the mixing impeller rotates at a first desired speed in a first rotation direction;

measuring an amount of torque required to rotate the mixing impeller;

detecting whether the amount of the torque required to rotate the mixing impeller decreases as an indication that a swirling flow exists in the components being mixed;

rotating the mixing impeller at the first desired speed in the first rotation direction until reaching one of a first time $t_{steady,1}$ or a detection that the swirling flow exists in the components being mixed;

changing the rotation direction of the mixing impeller, so that the mixing impeller rotates in a second rotation direction at a second desired speed upon reaching one of the first time $t_{steady,1}$ and the detection that the amount of the torque required to rotate the mixing impeller has decreased as the indication that the swirling flow exists in the components being mixed;

rotating the mixing impeller at the second desired speed and in the second rotation direction until reaching one of a second time $t_{steady,2}$ or the detection that the amount of the torque required to rotate the mixing impeller has decreased as an indication the swirling flow exists in the components being mixed; and further comprising using a control system that controls the mixing impeller and detects whether the amount of the torque required to rotate the mixing impeller fluctuates as an indication of one or more vortexes in the components being mixed; and then rotating the mixing impeller at the second desired speed and in the second rotation direction until reaching one of the second time $t_{steady,2}$ or the detection that the amount of the torque required to rotate the mixing impeller has decreased or fluctuated again.

2. The mixing method of claim 1, comprising a further step of changing the rotation direction of the mixing impeller from the second rotation direction back to the first rotation direction upon reaching one of the second time $t_{steady,2}$ or the detection that the swirling flow exists in the components being mixed.

3. The mixing method of claim 1, wherein the first or the second desired speed is a maximum speed of the mixing impeller.

4. The mixing method of claim 1, wherein the time at which the swirling flow is detected in the components to be mixed is determined in the control system for controlling the mixing impeller.

* * * * *